US010405084B2

(12) United States Patent
Sullivan et al.

(10) Patent No.: US 10,405,084 B2
(45) Date of Patent: Sep. 3, 2019

(54) LOUDSPEAKER WITH DEFLECTOR AT A PORT EXIT

(71) Applicant: Bose Corporation, Framingham, MA (US)

(72) Inventors: Donna Marie Sullivan, Brimfield, MA (US); John Lawrence McGrael, Cambridge, MA (US); Christopher Glenn Donaldson, South Grafton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/690,739

(22) Filed: Aug. 30, 2017

(65) Prior Publication Data

US 2019/0069077 A1 Feb. 28, 2019

(51) Int. Cl.

| | |
|---|---|
| ***H04R 1/02*** | (2006.01) |
| ***H04R 1/28*** | (2006.01) |
| ***H04R 1/24*** | (2006.01) |
| ***H04R 1/34*** | (2006.01) |
| *H04R 9/02* | (2006.01) |

(Continued)

(52) U.S. Cl.

CPC ..... *H04R 1/2873* (2013.01); *H04R 1/023* (2013.01); *H04R 1/025* (2013.01); *H04R 1/24* (2013.01); *H04R 1/2819* (2013.01); *H04R 1/2896* (2013.01); *H04R 1/345* (2013.01); *H04R 1/2888* (2013.01); *H04R 9/025* (2013.01);

(Continued)

(58) Field of Classification Search

CPC ..... H04R 1/023; H04R 1/24; H04R 1/2819; H04R 1/2834; H04R 1/2857; H04R 1/2861; H04R 1/2873; H04R 9/025; H04R 9/06; H04R 2201/029; H04R 1/345

USPC ..... 381/335, 337, 338, 341, 345, 349, 350, 381/351, 352, 160, 386, 189; 181/152, 181/155, 156, 192, 199

See application file for complete search history.

(56) References Cited

U.S. PATENT DOCUMENTS

| | | | | |
|---|---|---|---|---|
| 3,909,530 A | | 9/1975 | Gosswiller | |
| 4,298,087 A | * | 11/1981 | Launay ..... | H04R 1/345 181/153 |

(Continued)

FOREIGN PATENT DOCUMENTS

| | | |
|---|---|---|
| CN | 203708464 U | 7/2014 |
| GB | 1462919 A | 1/1977 |

OTHER PUBLICATIONS

International Search Report and Written Opinion dated Jan. 3, 2019 for International application No. PCT/US2018/048157.

*Primary Examiner* — Huyen D Le

(57) ABSTRACT

A loudspeaker comprising an acoustic package including an acoustic enclosure that defines an acoustic cavity, a loudspeaker component supported on the acoustic enclosure, a port arranged in the acoustic package and extending from a first open end portion acoustically coupled to the acoustic cavity, to a second end portion acoustically coupled to a region external to the acoustic cavity, the second end portion being arranged for directing air flow exiting the port generally towards the loudspeaker component, and a deflector located between the second end portion of the port and the loudspeaker component, the deflector being arranged for at least partially diverting air flow exiting the port away from the loudspeaker component, towards the region external to the acoustic cavity.

23 Claims, 3 Drawing Sheets

(51) Int. Cl.
*H04R 9/06* (2006.01)
*H04R 9/04* (2006.01)

(52) U.S. Cl.
CPC ..... *H04R 9/043* (2013.01); *H04R 9/06* (2013.01); *H04R 2400/11* (2013.01)

(56) References Cited

U.S. PATENT DOCUMENTS

| | | | | | |
|---|---|---|---|---|---|
| 4,860,367 | A | * | 8/1989 | Hook | H04R 1/2865 381/341 |
| 5,189,706 | A | * | 2/1993 | Saeki | H04R 1/2826 181/155 |
| 5,266,752 | A | | 11/1993 | Cussans | |
| 5,432,860 | A | * | 7/1995 | Kasajima | H04R 1/30 181/152 |
| 2016/0112023 | A1 | | 4/2016 | Croft, III | |

* cited by examiner

LOUDSPEAKER WITH DEFLECTOR AT A PORT EXIT

BACKGROUND

This disclosure relates to a loudspeaker.

Some loudspeakers have an acoustic package including an acoustic enclosure that defines an acoustic cavity, and a port arranged in the acoustic package and extending from a first open end portion acoustically coupled to the acoustic cavity, to a second end portion acoustically coupled to the region external to the acoustic cavity.

If the second end portion of the port is configured to direct air flow exiting the port towards a loudspeaker component, such as at least a part of an electro-acoustic transducer of the loudspeaker, for example to make the acoustic package as compact as possible, this can create air turbulence and generate noise in front of the loudspeaker component. This noise is undesirable as it can degrade the perceived sound quality delivered by the loudspeaker.

SUMMARY

The present invention addresses this problem by proposing a solution to reduce noise for loudspeakers of the type discussed above.

In one aspect, the present invention proposes a loudspeaker comprising:

an acoustic package including an acoustic enclosure that defines an acoustic cavity, a loudspeaker component supported on the acoustic enclosure, a port arranged in the acoustic package and extending from a first open end portion acoustically coupled to the acoustic cavity, to a second end portion acoustically coupled to a region external to the acoustic cavity, the second end portion being arranged for directing air flow exiting the port generally towards the loudspeaker component, and a deflector located between the second end portion of the port and the loudspeaker component, the deflector being arranged for at least partially diverting air flow exiting the port away from the loudspeaker component, towards the region external to the acoustic cavity.

Embodiments may include one of the following features, or any combination thereof:

the loudspeaker component comprises at least a part of a first electro-acoustic transducer having a first radiating surface arranged for radiating acoustic energy to the region external to the acoustic cavity and a second radiating surface arranged for radiating acoustic energy into the acoustic cavity;

said part of the first electro-acoustic transducer comprises the first radiating surface of the first electro-acoustic transducer;

the deflector is arranged in a part of the acoustic enclosure that is separate from the port;

the deflector is arranged in the second end portion of the port;

the deflector comprises an element separate from the acoustic enclosure and the port;

the deflector has a surface that is angled or curved so as to divert a desired proportion of air flow exiting the port away from the loudspeaker component towards the region external to the acoustic cavity;

the loudspeaker further comprises a housing surrounding the acoustic package, the housing including a perforated grille extending on only part of a surface of the housing, such that a portion of the grille faces the first radiating surface of the first electro-acoustic transducer but no portion of the grille faces the deflector;

the second end portion of the port runs substantially linearly along a surface of the acoustic enclosure.

the second end portion of the port runs along a side portion of the acoustic enclosure;

at least another portion of the port runs substantially linearly along another surface of the acoustic enclosure;

at least another portion of the port runs along a top surface of the acoustic enclosure;

said at least another portion of the port is substantially normal to at least one of the first and second end portions of the port;

the first and second end portions of the port are substantially parallel to each other;

an axis of the second end portion of the port is substantially normal to a motion axis of the first electro-acoustic transducer;

the loudspeaker comprises a second electro-acoustic transducer supported on the acoustic enclosure and having a first radiating surface arranged for radiating acoustic energy to a region external to the acoustic cavity and a second radiating surface arranged for radiating acoustic energy into the acoustic cavity;

the first and second electro-acoustic transducers are driven with parallel and coaxial directions of motion;

the first and second electro-acoustic transducers are arranged for being acoustically in phase and mechanically out of phase, when delivering the same audio content;

first and second magnetic structures are mounted on a common axis and close to the second radiating surface of the first and second electro-acoustic transducers respectively;

the first and second magnetic structures are separate from each other by a distance of 2 mm or less;

the first and second magnetic structures are bipolarized and have surfaces of same polarities facing each other;

the first and second magnetic structures are bipolarized and have surfaces of opposite polarities facing each other;

the first and second magnetic structures are arranged such that their respective magnetic fields constructively interfere with each other.

DETAILED DESCRIPTION

In the following, an example loudspeaker is described. But the skilled person will understand that the shape and structure of the loudspeaker and of its various components may differ from those described below and shown in the figures.

Figure 1:
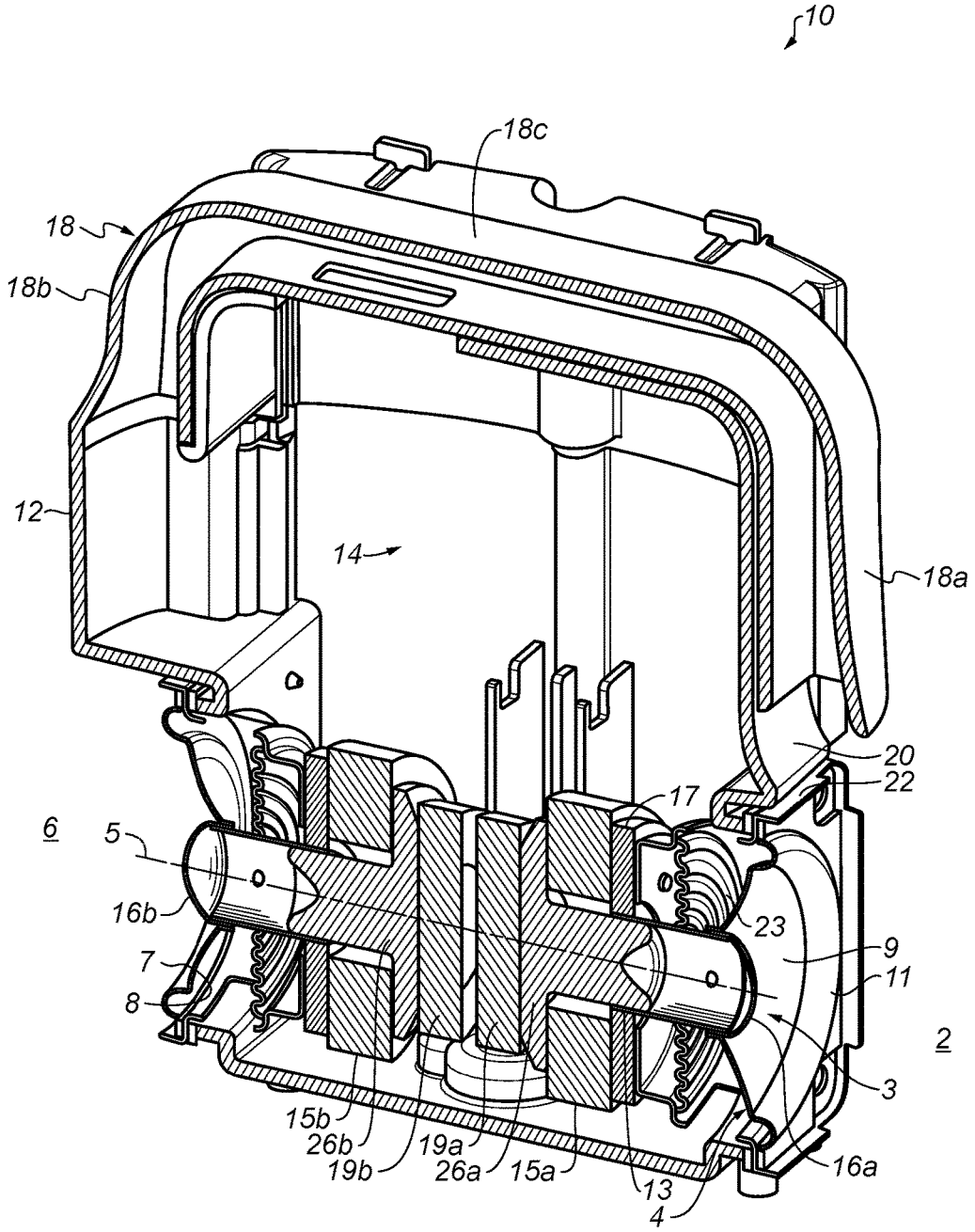
FIG. 1 is a cross-sectional view of the acoustic package of an example loudspeaker of the invention.

FIG. 1 shows an acoustic package 10 of a loudspeaker. The acoustic package 10 includes an acoustic enclosure 12 that defines an acoustic cavity 14. The loudspeaker also comprises a first electro-acoustic transducer 16*a* supported on the acoustic enclosure 12 and having a first radiating surface 3 arranged for radiating acoustic energy to a region 2 external to the acoustic cavity 14 (i.e. outside of the acoustic cavity) and a second radiating surface 4 arranged for radiating acoustic energy into the acoustic cavity 14.

The active electro-acoustic transducer 16*a* can be any known type of electro-acoustic transducer. For example, as shown in FIG. 1, the transducer 16*a* can include an electric motor, a diaphragm assembly and a suspension. The motor may include a magnetic circuit 26*a* and a voice coil assembly 13 which is driven in motion by the magnetic circuit 26*a*. The magnetic circuit may include a back plate 19*a*, a center pole 21, a front plate 17, and a permanent magnet 15*a*. The front plate 17 and the center pole 21 together may form a gap within which the voice coil assembly may be disposed. The magnet 15*a* provides a permanent magnetic field to oppose an alternating electromagnetic field of the voice coil assembly and thereby cause the attached diaphragm assembly to move. The voice coil assembly 13 may include a voice coil and a bobbin. The diaphragm assembly may include a diaphragm 9 and, possibly, a dust cap. The suspension 11 may include a spider 23 and a surround 11. The spider 23 may couple the bobbin to a frame 22 affixed to the acoustic enclosure 12, and the surround 11 may couple the diaphragm 9 to the frame 22. The suspension may assist in keeping the voice coil centered, both axially and radially, within the gap of the magnetic circuit. When the electrical current in the voice coil changes direction, the magnetic forces between the voice coil and the fixed magnet also change, causing the voice coil to move along a motion axis 5. This going and coming movement of the voice coil translates to movement of the diaphragm 9. This movement of the diaphragm 9 causes changes in air pressure, which results in production of sound. In this non-limiting example, the surfaces 3 and 4 of the electro-acoustic transducer 16*a* are opposite surfaces of the diaphragm 9 and most parts of the transducer 16*a* are located inside the acoustic package 10. As the skilled person will appreciate, other types or arrangements are also possible for the electro-acoustic transducer 16*a*.

In addition, a port 18 is arranged in the acoustic package 10. The port 18 has a first open end portion 18*b* acoustically coupled to the acoustic cavity 14. On its other end, the port 18 has a second end portion 18*a* acoustically coupled to the region 2 external to the acoustic cavity. The length of the end portions 18*a* and 18*b* can vary depending on the needs. The end portion 18*a* is arranged for directing air flow exiting the port 18 towards or generally towards the radiating surface 3 of the electro-acoustic transducer 16*a*. In this way, a substantial part of the air flow exiting the port 18 from the end portion 18*a* would end up in turbulent interaction with geometry on the transducer 16*a* or the flow from the radiation surface 3, thus generating noise, if the deflector 20 that will be discussed further below was not present. In the example shown in FIG. 1, this is achieved with an end portion 18*a* that has a substantially tubular shape directed towards the radiating surface 3 of the electro-acoustic transducer 16*a*. Note that, in FIG. 1, the tubular end portion 18*a* does not have a constant cross section along its entire length, as it widens towards its open end. However, a constant section or even a non-tubular shape would also be possible for the end portion 18*a*, provided that the latter directs some air flow exiting the port generally towards the radiating surface 3 of the electro-acoustic transducer 16*a*.

In the example shown in FIG. 1, the port 18 comprises three main portions: the end portions 18*a* and 18*b* mentioned above, as well as another intermediate portion 18*c* located between the two end portions. The end portion 18*a* of the port 18 runs substantially linearly along a surface of the acoustic enclosure 12, in this case along a side portion of the acoustic enclosure 12. And the intermediate portion 18*c* runs substantially linearly along another surface of the acoustic enclosure 12, here along the top surface of the acoustic enclosure 12. The intermediate portion 18*c* is also substantially normal to both end portions 18*a* and 18*b* of the port 18 (which are substantially parallel to each other in this example). This embodiment is advantageous since, because the port partly follows the contours of the acoustic package, the resulting overall shape of the package is particularly compact. However, none of the specific arrangements shown in FIG. 1 must be considered as being limiting. Any other suitable geometries could be used instead. For example, the end portions 18*a* and 18*b* may not be parallel to each other, and the intermediate portion 18*c* may not be normal to any or both of end portions 18*a* and 18*b*. The port 18 may have more or less than three portions, e.g. it may have more than one intermediate portion. Any portion of the port 18 may not run linearly along a surface of the acoustic enclosure 12. The portions of the port 18 may run along surfaces of the acoustic enclosure 12, different from those shown in FIG. 1, or not run at all along any surfaces of the acoustic enclosure 12.

The loudspeaker further comprises a deflector 20 located between the end portion 18*a* of the port 18 and the radiating surface 3 of the electro-acoustic transducer 16*a*. This deflector 20 is arranged for at least partially diverting air flow exiting the port 18 away from the radiating surface 3 of the electro-acoustic transducer 16*a*, towards the region 2 external to the acoustic cavity 14 (i.e. to the outside of the acoustic package 10). For example, the deflector 20 may assist in diverting exhausted air flow away from the frame 22 of the transducer 16*a*. In the non-limiting example described herein, an axis of the end portion 18*a* of the port 18 is substantially normal to the motion axis 5 of the electro-acoustic transducer 16*a*, although other arrangements are also possible. When the air flow from the port 18 is perpendicular to both geometry of the electro-acoustic transducer 16*a* and the flow from the radiating surface 3, maximum benefits can be achieved by using the deflector.

In the context of the present invention, the word "deflector" is to be understood in the broadest possible way, to designate any means capable of contributing to divert air flow exiting the port 18 away from a component of the loudspeaker, towards the outside of the acoustic cavity 14. By so diverting air flow, the deflector helps to reduce the level of air turbulence created at the port exit and in proximity to the loudspeaker component, thus reducing noise and thereby improving the quality of sounds delivered by the loudspeaker. In the example described with reference to the figures, the loudspeaker component in question is the radiating surface 2 of the electro-acoustic transducer 16*a*. However, in other embodiments, the loudspeaker component may consist in or comprise other parts of the electro-acoustic transducer 16*a*, such as part or whole of the suspension 11, a basket or housing that supports the active parts of the transducer 16*a*, and/or any other portion of the transducer 16*a*. In other embodiments, the loudspeaker component may even consist in or comprise other components of the loudspeaker that are not part of the electro-acoustic transducer 16*a*, but are nevertheless located near the port exit. As non-limiting examples, such loudspeaker components may be electronic and/or mechanical elements of the loudspeaker, and they may comprise any of a circuit board, a microphone, or any other element susceptible to be subject to turbulent interaction with air flow exiting the port 18.

The deflector may comprise electronic means, mechanical means, or a combination of electronic and mechanical means, and/or other suitable means. In FIG. 1, the deflector 20 consists in mechanical means, in the form of a lip that is shaped to move at least some air exiting the port 18 away from the radiating surface 2 of the electro-acoustic transducer 16*a*. In the figure, this is achieved by the lip having a surface that is curved towards the outside of the acoustic package as it comes closer to this radiating surface 3. This representation is in no way limiting though. Other curved shapes, such as a more convex curve rather than a generally concave curve, are also possible. Moreover, the deflector may have a surface that is angled rather than curved, or a surface that comprises a combination of angled and curved portions to air exiting the port 18 away from the radiating surface 2 of the electro-acoustic transducer 16*a*. Some other geometries are also possible as will be apparent to the skilled person. When the deflector 20 has a surface that is angled and/or curved, the angle and/or curvature are advantageously selected so as to divert a desired proportion of air flow exiting the port 18 away from the radiating surface 3 of the electro-acoustic transducer 16*a* towards the region 2 external to the acoustic cavity 14. In this way, the level of noise reduction achieved can be controlled.

In the example of FIG. 1, the deflector 20 is arranged in a part of the acoustic enclosure 12 that is separate from the port 20. In other examples, the deflector may be arranged in the end portion 18*a* of the port 18 itself, and/or it may be or comprise an element separate from the acoustic enclosure 14 and the port 18.

While this is not required by the present invention, the example loudspeaker whose acoustic package 10 is shown in FIG. 1 can further comprise a second electro-acoustic transducer 16*b* supported on the acoustic enclosure 12 and having a first radiating surface 7 arranged for radiating acoustic energy to a region 6 external to the acoustic cavity and a second radiating surface 8 arranged for radiating acoustic energy into the acoustic cavity 14. The electro-acoustic transducer 16*b* can be any type of known transducers. It may be of the same type as the electro-acoustic transducer 16*a*, or the transducers 16*a* and 16*b* may be of different types.

Advantageously, both transducers 16*a* and 16*b* of the loudspeaker are driven with parallel and coaxial directions of motion (along the motion axis 5), although non-parallel and/or non-coaxial directions of motion are also possible. In the example shown in the figures, radiating surfaces of the transducers 16*a* and 16*b* radiate to regions 2 and 6 respectively, that are located at opposite sides of the acoustic package, although other configurations are also possible. The transducers 16*a* and 16*b* may also be arranged for being acoustically in phase and mechanically out of phase, when delivering the same audio content. In this way, vibrations transmitted to the acoustic enclosure 12 by moving parts of the transducers can cancel out.

As also shown in the non-limiting embodiment of FIG. 1, magnetic circuits 26*a* and 26*b* may be mounted on a common axis (which is the same as the motion axis 5 of the transducers 16*a* and 16*b* in this case) and close to the radiating surfaces of the electro-acoustic transducers that radiate acoustic energy into the acoustic cavity, respectively. In this example, the magnetic circuits 26*a* and 26*b* of the respective transducers 16*a* and 16*b* are in close proximity to each other. For instance, back plates 19*a* and 19*b* of said magnetic circuits 26*a* and 26*b* may be the parts of the transducers 16*a* and 16*b* in closer proximity to each other. For example, the magnetic circuits 26*a* and 26*b* may be separate from each other by a distance of 10 mm or less, or possibly by a distance of 5 mm or less, or possibly by a distance of 3 mm or less, or even by a distance of 2 mm or less. Such arrangement further contributes to the compactness of the acoustic package 10 and of the loudspeaker containing it.

In some embodiments, the magnetic circuits 26*a* and 26*b* of the respective transducers 16*a* and 16*b* may be bipolarized and have surfaces of same polarities facing each other. In other embodiments, the magnetic circuits 26*a* and 26*b* may be bipolarized and have surfaces of opposite polarities facing each other. In some embodiments, the magnetic circuits 26*a* and 26*b* are arranged such that their respective magnetic fields constructively interfere with each other. The parts of the magnetic circuits 26*a* and 26*b* that are so bipolarized and/or arranged may be magnets 15*a* and 15*b* of the magnetic circuits 26*a* and 26*b* respectively. Alternatively, other parts of the magnetic circuits 26*a* and 26*b* may play that role.

Figure 2:
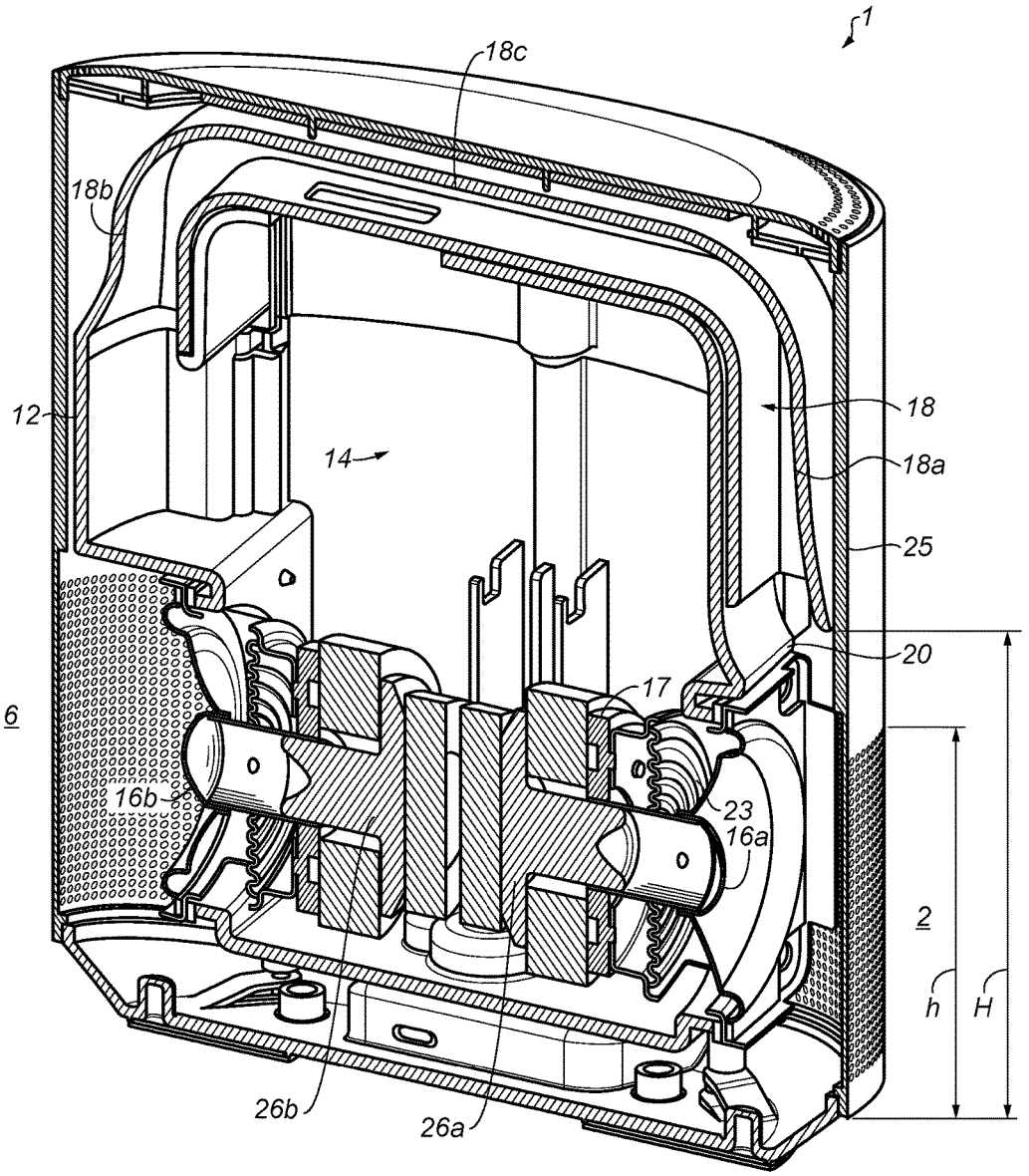
FIG. 2 is a cross-sectional view of an example loudspeaker of the invention.
Figure 3:
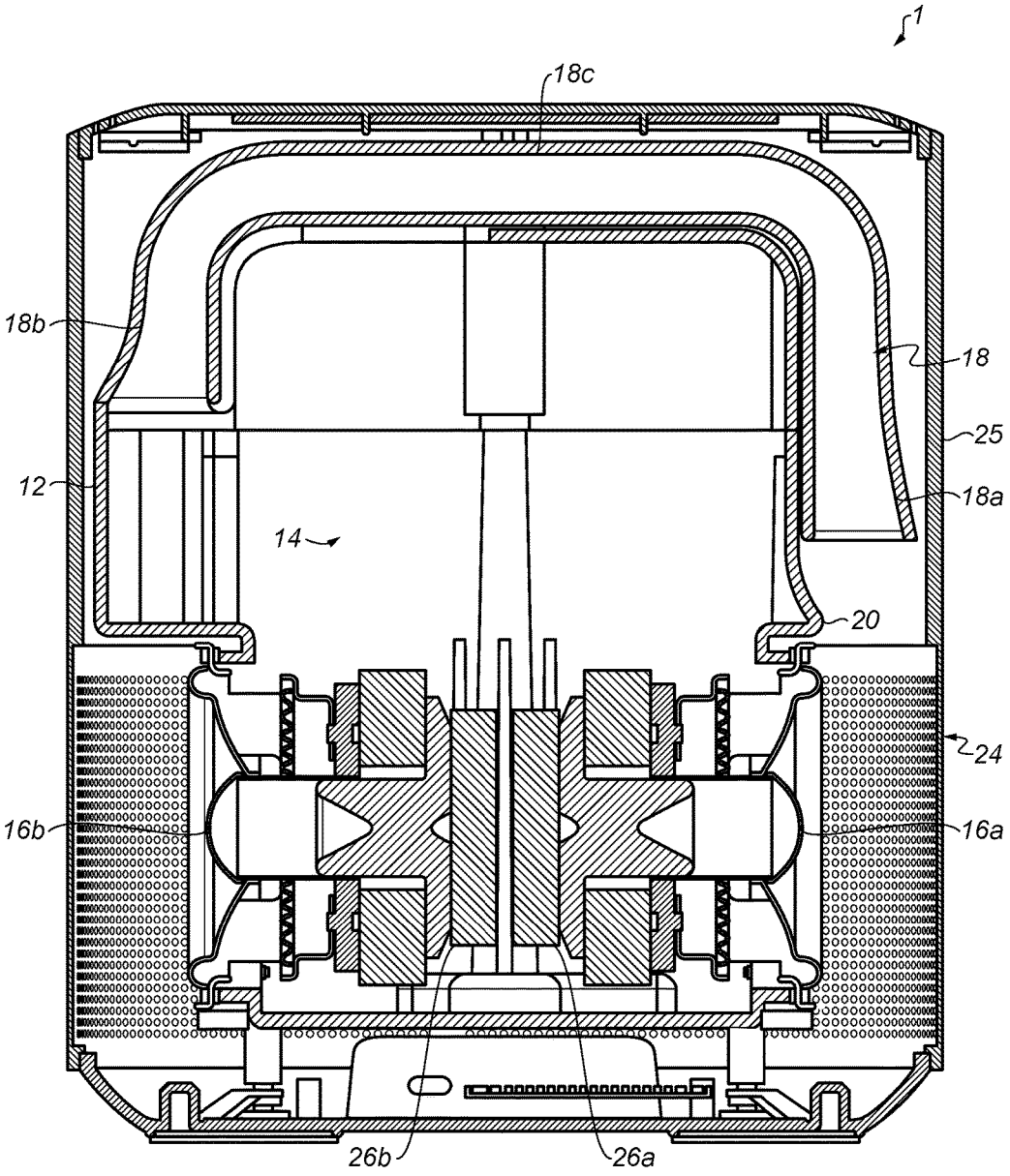
FIG. 3 is another cross-sectional view of the example loudspeaker of FIG. 2.

FIGS. 2 and 3 show different views of an example loudspeaker 1. This loudspeaker 1 comprises the same acoustic package 10 as shown in FIG. 1 (hence the use of the same reference numbers for simplicity). It also comprises a housing 25 surrounding the acoustic package 10.

In the advantageous embodiment shown in the figures, the housing 25 includes a perforated grille 24 that extends on only part of a surface of the housing. In FIGS. 2 and 3, this part is in the lower portion of the housing, while the upper portion of the housing is not covered with a perforated grille. More specifically, the housing 25 is arranged such that a portion of the grille 24 faces the radiating surface 16*a* of the electro-acoustic transducer 16*a*, but no portion of the grille 24 faces the deflector 20 (only a non-perforated portion of the housing 25 faces the deflector 20). That is, the height, h, of the grille 24 is below the height, H, of the port exit with a solid portion of the housing facing the port exit and such that air expelled from the port exit is directed downward toward the transducer 26*a* where it can escape via the grille 24. Compared to a configuration where a perforated grille would face the deflector 20, for example by having a perforated grille extending on the entire surface of the housing, this optional arrangement further reduces noise that would otherwise result from air flow exiting the port 18 and being diverted from the radiating surface 16*a* of the electro-acoustic transducer 16*a*, going right away outside of the housing 25 through vents of the perforated grille. Because of the distance lying between the end portion 18*a* of the port 18 and the top of the perforated grille 24, air flow exiting the port 18 will escape the loudspeaker through the perforated grille 24 with less ease, as it comes in a direction different from that of an axis of the vents of the perforated grille 24 (i.e. in a direction that is not normal to the perforated grille 24). Air turbulence generated when air flow goes through the vents the perforated grille 24 is thus reduced, thereby reducing noise even further. The distance lying between the end portion 18*a* of the port 18 and the top of the perforated grille 24 can be set depending on the desired level of noise reduction.

A number of implementations have been described. Nevertheless, it will be understood that additional modifications may be made without departing from the scope of the inventive concepts described herein, and, accordingly, other embodiments are within the scope of the following claims.

The invention claimed is:

1. A loudspeaker comprising:

an acoustic package including an acoustic enclosure that defines an acoustic cavity, an electro-acoustic transducer supported on the acoustic enclosure, a port arranged in the acoustic package and extending from a first open end portion acoustically coupled to the acoustic cavity, to a second end portion acoustically coupled to a region external to the acoustic cavity, the second end portion being arranged for directing air flow exiting the port generally towards the electro-acoustic transducer, and a deflector located between the second end portion of the port and the electro-acoustic transducer, the deflector being arranged for at least partially diverting air flow exiting the port away from the electro-acoustic transducer, towards the region external to the acoustic cavity.

2. The loudspeaker of claim 1, wherein the electro-acoustic transducer has a first radiating surface arranged for radiating acoustic energy to the region external to the acoustic cavity and a second radiating surface arranged for radiating acoustic energy into the acoustic cavity.

3. The loudspeaker of claim 2, wherein the second end portion is arranged for directing air flow exiting the port generally towards the first radiating surface of the electro-acoustic transducer.

4. The loudspeaker of claim 2, further comprising a housing surrounding the acoustic package, the housing including a perforated grille extending on only part of a surface of the housing, such that a portion of the grille faces the first radiating surface of the electro-acoustic transducer but no portion of the grille faces the deflector.

5. The loudspeaker of claim 2, wherein an axis of the second end portion of the port is substantially normal to a motion axis of the electro-acoustic transducer.

6. The loudspeaker of claim 2, comprising a second electro-acoustic transducer supported on the acoustic enclosure and having a first radiating surface arranged for radiating acoustic energy to a region external to the acoustic cavity and a second radiating surface arranged for radiating acoustic energy into the acoustic cavity.

7. The loudspeaker of claim 6, wherein the first and second electro-acoustic transducers are driven with parallel and coaxial directions of motion.

8. The loudspeaker of claim 6, wherein the first and second electro-acoustic transducers are arranged for being acoustically in phase and mechanically out of phase, when delivering the same audio content.

9. The loudspeaker of claim 6, wherein first and second magnetic structures are mounted on a common axis and close to the second radiating surface of the first and second electro-acoustic transducers respectively.

10. The loudspeaker of claim 9, wherein the first and second magnetic structures are separate from each other by a distance of 2 mm or less.

11. The loudspeaker of claim 9, wherein the first and second magnetic structures are bipolarized and have surfaces of same polarities facing each other.

12. The loudspeaker of claim 9, wherein the first and second magnetic structures are bipolarized and have surfaces of opposite polarities facing each other.

13. The loudspeaker of claim 9, wherein the first and second magnetic structures are arranged such that their respective magnetic fields constructively interfere with each other.

14. The loudspeaker of claim 1, wherein the deflector is arranged in a part of the acoustic enclosure that is separate from the port.

15. The loudspeaker of claim 1, wherein the deflector is arranged in the second end portion of the port.

16. The loudspeaker of claim 1, wherein the deflector comprises an element separate from the acoustic enclosure and the port.

17. The loudspeaker of claim 1, wherein the deflector has a surface that is angled or curved so as to divert a desired proportion of air flow exiting the port away from the electro-acoustic transducer towards the region external to the acoustic cavity.

18. The loudspeaker of claim 1, wherein the second end portion of the port runs substantially linearly along a surface of the acoustic enclosure.

19. The loudspeaker of claim 18, wherein the second end portion of the port runs along a side portion of the acoustic enclosure.

20. The loudspeaker of claim 18, wherein at least another portion of the port runs substantially linearly along another surface of the acoustic enclosure.

21. The loudspeaker of claim 20, wherein at least another portion of the port runs along a top surface of the acoustic enclosure.

22. The loudspeaker of claim 21, wherein said at least another portion of the port is substantially normal to at least one of the first and second end portions of the port.

23. The loudspeaker of claim 1, wherein the first and second end portions of the port are substantially parallel to each other.

* * * * *